US011471927B2

(12) United States Patent
Tiraferri et al.

(10) Patent No.: US 11,471,927 B2
(45) Date of Patent: Oct. 18, 2022

(54) LOADING METHOD FOR A MACHINE TOOL AND TOOL TRANSFER DEVICE

(71) Applicant: TRUMPF Maschinen Austria GmbH & Co. KG., Pasching (AT)

(72) Inventors: Matteo Tiraferri, San Gillio (IT); Andrea Tonda Roch, Turin (IT); Giovanni Vidotto, Chieri (IT)

(73) Assignee: TRUMPF MASCHINEN AUSTRIA GMBH & CO. KG, Pasching (AT)

( * ) Notice: Subject to any disclaimer, the term of this patent is extended or adjusted under 35 U.S.C. 154(b) by 854 days.

(21) Appl. No.: 16/342,629

(22) PCT Filed: Oct. 19, 2017

(86) PCT No.: PCT/AT2017/060277

§ 371 (c)(1),
(2) Date: Apr. 17, 2019

(87) PCT Pub. No.: WO2018/071945

PCT Pub. Date: Apr. 26, 2018

(65) Prior Publication Data

US 2019/0262888 A1 Aug. 29, 2019

(30) Foreign Application Priority Data

Oct. 20, 2016 (AT) ..... A 50960/2016

(51) Int. Cl.
*B21D 37/04* (2006.01)
*B21D 5/02* (2006.01)
(Continued)

(52) U.S. Cl.
CPC ..... *B21D 37/04* (2013.01); *B21D 5/0254* (2013.01); *B21D 37/147* (2013.01); *H01F 7/206* (2013.01); *H01F 2007/208* (2013.01)

(58) Field of Classification Search
CPC B23Q 3/15513; B23Q 3/1554; B23Q 3/1556; B23Q 3/15573; B21D 5/0209;
(Continued)

(56) References Cited

U.S. PATENT DOCUMENTS 4,530,028 A 7/1985 Metz et al.
5,595,560 A 1/1997 Kamada
(Continued)

FOREIGN PATENT DOCUMENTS

CN 103261984 A 8/2013
CN 105099281 A 11/2015
(Continued)

OTHER PUBLICATIONS

Felder, Translation of WO-2015176083-A1 (Year: 2015).*
(Continued)

*Primary Examiner* — Jessica Cahill
*Assistant Examiner* — Bobby Yeonjin Kim
(74) *Attorney, Agent, or Firm* — Collard & Roe, P.C.

(57) ABSTRACT

The invention relates to a loading method for a machine tool (12), especially for a bending machine, having a tool-transfer device (1), a tool holder (17) of the machine tool (12), and a tool rack (13), wherein the tool holder (17) and the tool rack (13) are connected via a guide rail (4), and the tool-transfer device (1) has a magnetic retaining device (5). The tool-transfer device (1) is moved to a machining tool (18), which is arranged in a pick-up position (20) in a tool holder (17) or in a tool rack (13). The machining tool (18) is picked up and retained by means of a magnetic retaining device (5) of the tool-transfer device (1) and moved along the guide track (4) to a deposition position (21). There the machining tool (18) is deposited by deactivation of the magnetic retaining force (22). The magnetic retaining device (5) has an electromagnet (6) having an electronic activating
(Continued)

device (7) wherein, upon deactivation of the magnetic retaining force (22), a demagnetization is performed by the activating device (7).

18 Claims, 5 Drawing Sheets

(51) Int. Cl.
*B21D 37/14* (2006.01)
*H01F 7/20* (2006.01)

(58) Field of Classification Search
CPC ..... B21D 5/0254; B21D 37/04; B21D 37/06; B21D 37/14; B21D 37/145; B21D 37/147
See application file for complete search history.

(56) References Cited

U.S. PATENT DOCUMENTS

| | | | |
|---|---|---|---|
| 6,188,151 | B1 | 2/2001 | Livshits et al. |
| 9,547,300 | B2 | 1/2017 | Angerer et al. |
| 2013/0027833 | A1 | 1/2013 | Rabe et al. |
| 2016/0151820 | A1 | 6/2016 | Woidasky |
| 2017/0144206 | A1 | 5/2017 | Felder |

FOREIGN PATENT DOCUMENTS

| | | | | | |
|---|---|---|---|---|---|
| CN | 205289339 | U | | 6/2016 | |
| DE | 31 12 465 | A1 | | 10/1982 | |
| DE | 32 12 465 | A1 | | 10/1983 | |
| DE | 10 2011 052 173 | B3 | | 9/2012 | |
| EP | 1 479 461 | A1 | | 11/2004 | |
| EP | 2 946 846 | A1 | | 11/2015 | |
| FR | 2 791 590 | A1 | | 10/2000 | |
| JP | H04-327917 | A | | 11/1992 | |
| JP | H10-192988 | A | | 7/1998 | |
| JP | 2003-117607 | A | | 4/2003 | |
| JP | 2016-132043 | A | | 7/2016 | |
| JP | 2016-530102 | A | | 9/2016 | |
| WO | 99/35656 | A2 | | 7/1999 | |
| WO | 01/08174 | A1 | | 2/2001 | |
| WO | WO-2015176083 | A1 | * | 11/2015 | ..... B21D 37/04 |
| WO | 2016/109862 | A1 | | 7/2016 | |

OTHER PUBLICATIONS

International Search Report in PCT/AT2017/060277, dated Feb. 27, 2018.
Letter of Austrian Patent Attorney to European Patent Office in PCT/AT2017/060277, dated Jul. 31, 2018, with English translation of relevant parts.
International Search Report in PCT/AT2017/060278, dated May 22, 2018.

* cited by examiner

LOADING METHOD FOR A MACHINE TOOL AND TOOL TRANSFER DEVICE

CROSS REFERENCE TO RELATED APPLICATIONS

This application is the National Stage of PCT/AT2017/060277 filed on Oct. 19, 2017, which claims priority under 35 U.S.C. § 119 of Austrian Application No. A 50960/2016 filed on Oct. 20, 2016, the disclosure of which is incorporated by reference. The international application under PCT article 21(2) was not published in English.

The invention relates to a loading method for a machine tool, especially for a bending machine and a tool-transfer device.

Machine tools usually have a machine frame, in which working means are disposed that are able to transmit a machining force to a workpiece, in order to form it. In order to permit a force transmission matched to the workpiece, the working means usually have tool holders, in which specifically designed machining tools can be inserted or arranged. For implementation of the individual machining steps, it is necessary to exchange the machining tools or to change them in their position. For this purpose, usually the tool holder is unlocked, so that the machining tools arranged therein can be manipulated. In a bending machine, the tool holder is linearly designed and extends over the entire length of the pressing bar. In the case of a manual reconfiguration of the machining tools, each individual machining tool must be grasped by the machine operator and taken out of the tool holder or pushed into the tool holder. This is still easily possible in the case of small tools for the machining of light materials, such as thin metal sheets, for example, but, in the case of tools for the machining of heavy structural parts, this requires considerable exertion of force or is no longer possible manually.

Systems or devices are known in which machining tools, which in the following will be understood as bending tools, are gripped by means of a gripper and removed or pushed from the front or from the machine interior of the bending machine. However, this requires a manipulating robot, which if necessary performs manipulating actions in the front region of the machine, in which case it must be ensured that no persons are jeopardized by the manipulating actions. It is also known how to push a packet of inserted bending tools by means of an ejector device from the tool holder onto a pick-up device disposed laterally in longitudinal extent of the pressing bar, after which this pick-up device is moved into a parked position or into a tool magazine.

A further possibility is disclosed in EP 2946846 A1, in which a tool-changing device for a forming press having a tool magazine and a transfer device for transfer of the forming tools from the tool magazine to the forming press is presented, wherein the one transfer device comprises a drivable push chain. The transfer device further comprises a cable-connected electromagnet for coupling of the forming tool.

However, such systems are usually characterized by a great complexity and usually require larger modifications or extensions of the machine.

In addition, there are also changing devices that are based on the fact that the machining tools being used are usually of metal and thus can be held by a magnet. For this purpose, a small retaining carriage is brought along the tool holder up to the machining tool, clings persistently to the machining tool due to the magnets disposed in the retaining carriage and is then able to pull this tool along the tool holder or change its position. Upon reaching of an end position, the magnetic retaining force is deactivated, whereby machining tool and retaining carriage detach from one another. In this situation, however, it is disadvantageous that, due to the acting magnetic field, a residual magnetism builds up in the metallic object, especially in the machining tool and also in the changing carriage. This may cause the machining tools to cling persistently to one another, such that they can be detached from one another no longer or only with difficulty. Furthermore, metallic debris, such as can be produced during the machining of metallic workpieces, may accumulate on the machining tools and on the changing carriage. It may also occur that the magnetized machining tools attract a lightweight metal sheet to be machined, whereby the alignment of the workpiece in relation to the machine tool may change, and thus a defective machining of the workpiece is performed.

The task of the invention now lies in creating a method and a compact device that permits a manipulation of metallic machining tools in a machine tool, wherein the manipulating actions do not have any feedback effect on the use as intended of the machining tools in the machine tool or on the changing device.

This task is accomplished by a method and a device according to the claims.

In particular, the task of the invention is accomplished by a loading method for a machine tool, especially for a bending machine. The machine tool comprises a tool-transfer device, a tool holder and a tool rack. The tool holder and the tool rack are connected to one another via guide track, and the tool-transfer device is disposed movably along the guide track. Machining tools, especially bending tools, are arranged in the tool holder and/or in the tool rack, and, furthermore, the tool-transfer device has a magnetic retaining device. In one step, the said tool-transfer device is then moved to a machining tool, which machining tool is arranged in a pick-up position in the tool holder or in the tool rack. This is followed by a pick-up and retention of the machining tool by means of a magnetic retaining device of the tool-transfer device and a movement of the picked-up machining tool along the guide track to a deposition position in the tool rack or in the tool holder. There a deposition of the machining tool takes place by deactivation of the magnetic retaining force. The magnetic retaining device has an electromagnet having an electronic activating device, wherein, upon deactivation of the magnetic retaining force, a demagnetization is performed by the activating device.

With this embodiment, it is ensured advantageously that no permanent residual magnetism is caused in the machining tool by the magnetic pick-up and retaining means. Thereby any existing residual magnetism is likewise reduced or dissipated. Thus no disturbances of the workflow are caused by metallic (dirt) particles or by lightweight metal parts that are to be machined but that cling to the machining tool due to a residual magnetism.

A further development consists in that the electromagnet, during deactivation of the retaining force, is subjected by the activating device to an electrical alternating current having decreasing signal amplitude. For example, the alternating current, which by definition is free of a direct component, may have a sinusoidal variation. However, other signal shapes are also conceivable.

According to a further development, it is also provided that the magnetic retaining device, especially the electromagnet, additionally has a permanent magnet, wherein the electromagnet, during deactivation of the retaining force, is subjected by the activating device to a direct-component-containing electrical alternating signal having decreasing signal amplitude. The advantage of this embodiment is that the energy expenditure for the activation of the electromagnet is reduced, since a permanent magnetic field, on which the magnetic field of the electromagnet is superposed, is always also available. For deactivation of the magnetic field, the activating signal must therefore have a direct component that generates a magnetic field equal to the strength of the permanent magnet but having the opposite field direction. Thus the two field components are deactivated and the resulting field is zero. A sinusoidal alternating current may likewise be used as the signal shape.

The decreasing signal amplitude according to the two further developments will preferably decrease according to an exponential function, for example according to $\exp(-x)$. Thus a very rapid reduction of a main component of a residual magnetism will be achieved. By selection of the frequency of the alternating signal and the demagnetization duration, a very good dissipation of an existing magnetic field may be achieved.

According to a further development, it is provided that, during the pick-up of the machining tool, the electromagnet is subjected by the activating device to an electrical pick-up and retention signal.

A further construction also consists in that the strength of the pick-up and retention signal of the activating device is changed over between a first signal strength for the pick-up of the machining tool and a second signal strength for the retention of the machining tool. For example, it may be of advantage when small and thus lightweight machining tools are picked up with a small magnetic retaining force, in order to prevent an adjacent machining tool from likewise being attracted by the magnetic force. In order to save energy, it is possible, for example, to reduce the magnetic force during the movement along the guide track. However, it is also possible to increase the magnetic force during the movement, in order to ensure a more secure retention at high travel speeds.

In this respect, a further development is advantageous according to which, during retention of the machining tool, the second signal strength of the pick-up and retention signal is disconnected. If, for example, the machining tool is being pushed by the transfer device, it may be that no or only a very small magnetic force is necessary in order to retain the machining tool securely in position. Thus a reduction of the energy consumption may again be achieved, or the time of action of the magnetic retaining force on the machining tool is reduced, which in turn leads to a smaller residual magnetism.

An advantageous further development also consists in that the second signal strength of the pick-up and retention signal is reduced prior to reaching of the deposition position. During the approach to the pick-up or deposition position of small and therefore lightweight machining tools, it is of advantage when the magnetic force is reduced before reaching of the target position, in order to prevent already arranged machining tools from being undesirably attracted.

According to a further development, it is provided that an identification feature of the machining tool is read by a sensing means connected to the activating device and tool-characterizing data, especially a tool shape, a tool weight and/or a tool length, are extracted from it by the activating device. As an example, the characterizing data may be directly resident in the identification feature. It is also possible that only one reference, which has a link to an entry in a characterizing-data table, is resident in the identification feature. This table may be located in the transfer device, especially in the activating device. It is also possible, however, that the table is filed in a data-processing system, which is connected to the activating device using data technology or via a wireless data link.

An advantageous further development consists further in that, based on the extracted tool shape, the tool weight and/or the tool length, the first and/or the second signal strength is read by the activating device from a resident parameter table. The necessary minimum magnetic force such that the machining tool can be picked up and retained reliably, as well as the maximum magnetic force such that an adjacent machining tool is not likewise picked up, depends quite substantially on the tool weight, the tool length and also the tool shape. Depending on this, different frictional resistances, which directly influence the minimum necessary magnetic force, will be established between tool holder and tool. With this further development, the appropriate magnetic retaining force can be used for each individual machining tool.

According to a further development, it is provided that the pick-up and retention signal is output by the activating device as a PWM signal (pulse width modulation) or as a PPM signal (pulse pause modulation). Details of these signals are not explained here, since they are known to a person skilled in the art.

A further development also consists in that the tool-transfer device has an electrical energy store connected to the activating device and a charging contact connected to the energy store. After movement of the tool-transfer device along the guide track into a parked position, the charging contact of the tool-transfer device is brought into connection with a charging terminal of the waiting position. With this further development, it is advantageously possible to recharge the energy store of the tool-transfer device during the loading pauses, so that sufficient energy for pick-up and for retention and especially for demagnetization of the machining tools is available for the next loading process. The presence of an energy store has the special advantage that no energy-supply cable is necessary, whereby a more free movability of the tool-transfer device along the guide track is possible.

A further development provides further that the tool-transfer device has, connected to the activating device, a position sensor, which determines the position of the tool-transfer device along the guide track and communicates a reaching of the pick-up position and/or a reaching of the deposition position to the activating device. Due to this further development, the magnetic retaining force can be adapted by the activating device on the way along the guide track, in order thereby, on the one hand to save energy and on the other hand to reduce the possibility that a magnetic field will build up in the machining tool.

An advantageous further development also consists in that the demagnetization is applied prior to reaching of the deposition position, especially immediately prior to the reaching of the deposition position. Since the demagnetization needs some time, and since a magnetic retaining force is still present at the beginning of the demagnetization, the demagnetization can already be started on the last portion of the way along the guide track, so that the waiting time at the deposition position until the completion of the demagnetization is shortened.

The task of the invention is also accomplished by a tool-transfer device for a loading method. This comprises an outer housing, a guide device for accommodation of the transfer device in a guide track, and a magnetic retaining device disposed on a front axial end of the housing. The magnetic retaining device has an electromagnet and, furthermore, an activating device is present, which is designed for the supply of the electromagnet with an electrical demagnetization signal, which demagnetization signal is an alternating signal having declining amplitude.

A further embodiment consists in that the outer housing (2) has an energy and/or data interface, whereby a compact embodiment of the transfer device is possible. In an embodiment as an energy interface, a supply of the electromagnet or of the activating device by an external energy supply is possible. In an embodiment as a data interface, the activating device may also be disposed externally if necessary, or a more selective activation of the electromagnet is possible.

A further development now consists in that a rechargeable energy store, which is connected to a charging contact on the housing outer side, is present in the housing. Thus it is ensured that a charging is possible without having to open the housing in order to gain access to the energy store.

According to a further development, it is also provided that a hitching device for a manipulator is provided at a rear axial end of the housing. The subject tool-transfer device may be part of a tool-administration device, which, for example, operates several machine tools or machining stations. This may be a central and universal manipulator, which can be connected via the hitching device to the specific tool-transfer device.

A further development consists in that the guide device has a drive, which is designed for movement of the transfer device along the guide track. Thereby a standalone tool-transfer device can be realized, which may independently perform a tool manipulation and in the process move itself along the guide track.

According to a further development, it is further provided that the activating device has a table, in which tool-characterizing data and associated parameters of a tool pick-up and retention signal are resident. By reading of the table entries, the activating device is able to obtain the characterizing variables for generation of the magnetic retaining force, especially the minimum retaining force necessary for the tool weight or the tool size and/or tool shape, in order to be able to retain the machining tool reliably.

A further possible embodiment consists in that a second electromagnet, which is subjected to an alternating current of constant amplitude, is disposed in one portion on the guide track. During the movement of the transfer device past the second electromagnet, a demagnetization of the transfer device takes place since, due to the movement past it, a decreasing amplitude of the magnetic force variation will be established. For this purpose, it may be provided that the second electromagnet is then switched on by a machine controller precisely when the transfer device, especially the front axial end of the housing, is situated at the position of the second electromagnet.

For better understanding of the invention, it will be explained in more detail on the basis of the following figures.

Therein, respectively in greatly simplified schematic diagrams,

Figure 1:
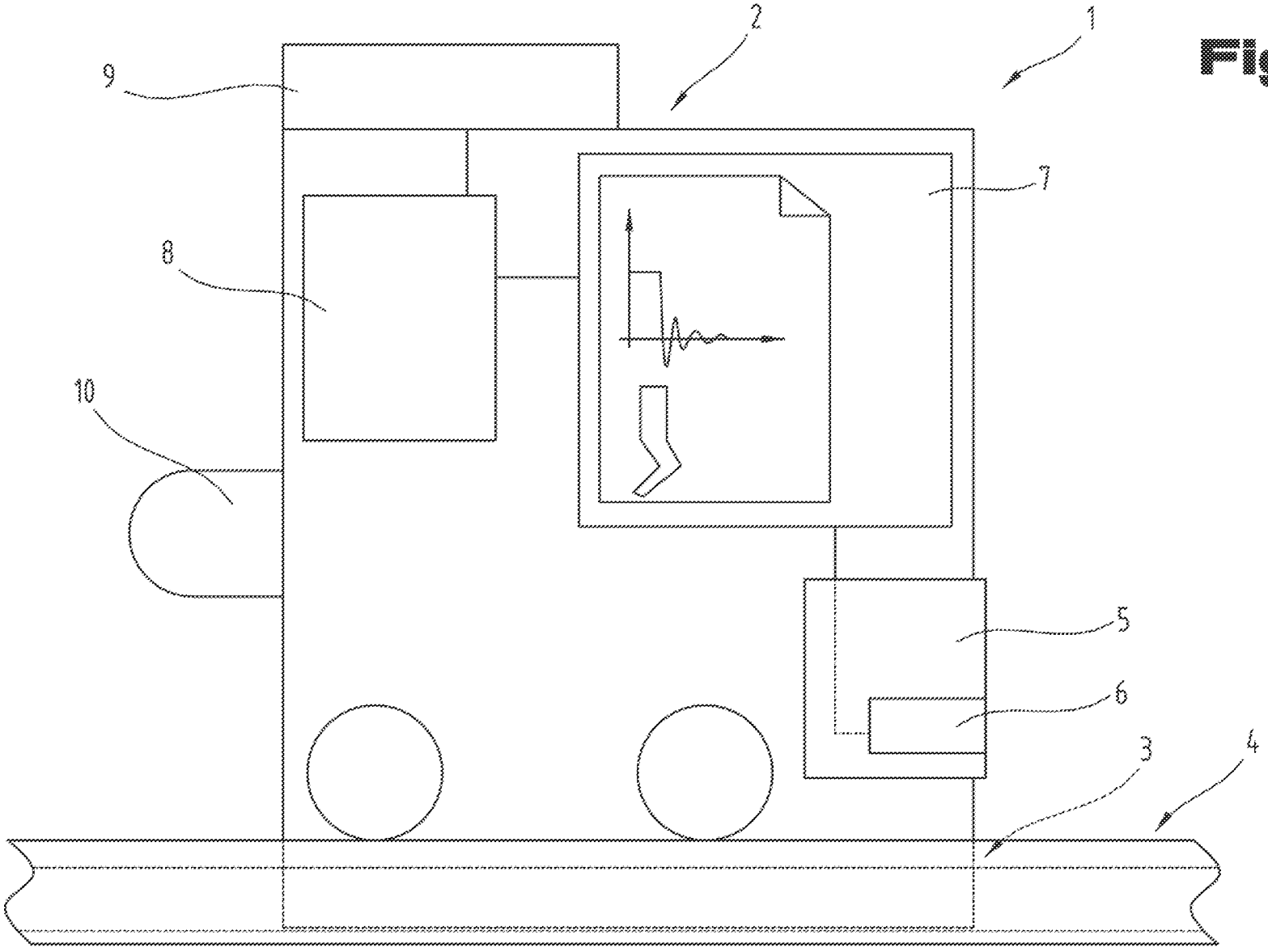
FIG. 1 shows a block diagram of a subject tool-transfer device.

FIG. 1 shows a tool-transfer device 1 for use in the subject loading method. The tool-transfer device 1 has an outer housing 2, a guide device 3 for pick-up of the transfer device 1 in a guide track 4, and a magnetic retaining device 5 disposed on a front axial end of the housing 2. The retaining device 5 further has an electromagnet 6, which is connected to an activating device 7, which is designed for the supply of the electromagnet 6 with an electrical demagnetization signal. In the housing 2, a rechargeable energy store 8 is further provided and is connected to a charging contact 9 provided on a housing outer side. Furthermore, a hitching device 10 for a manipulator is provided on the housing, especially at a rear axial end, and opposite the retaining device 5.

Figure 2:
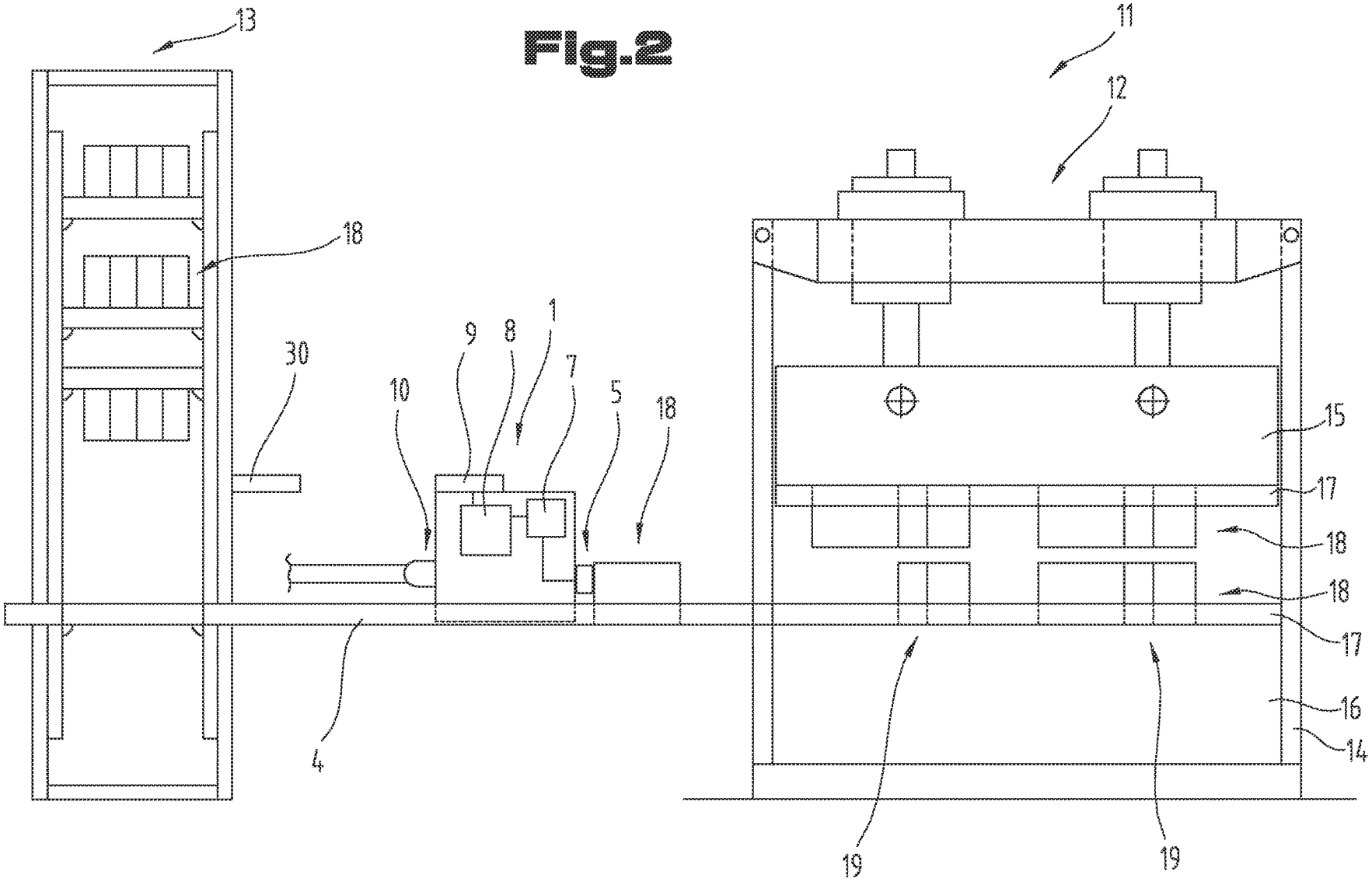
FIG. 2 shows a system comprising machine tool, transfer device and tool magazine.

FIG. 2 shows a machining system 11, in which the subject loading method is carried out with a tool-transfer device 1. The machining system 11 comprises a machine tool 12, especially a bending machine and a tool rack 13, which are connected to one another via a guide track 4, wherein the tool-transfer device 1 is disposed movably along this guide track 4.

The machine tool 12 has a machine frame 14, which has a pressing bar 15 movable vertically therein and a fixed machine table 16. Further technical details of the machine tool 12, especially a bending press, are not described further herein, since this would not provide any contribution to the subject loading method or to the tool-transfer device.

The subject loading method is designed to move machining tools between a pick-up and a deposition position. This means in particular that it moves tools from a tool rack 13 as the pick-up position to the machine tool 12 as the deposition position, and, synonymously, tools from the machine tool 12 as the pick-up position to the tool rack 13 as the deposition position. The latter situation is illustrated in FIG. 2.

The machine table 16 has a tool holder 17, in which machining tools 18, especially bending tools, are arranged. Likewise, the pressing bar 15 also has a tool holder 17, in which machining tools 18 are also arranged.

In the tool holder 17, machining tools 18 are arranged at several machining positions 19, wherein these may be different in type, so that different machining processes may be performed at the individual machining positions 19. For setup of these machining positions 19, the machining tools 18 must now be removed from the tool holder 17 and deposited in a tool rack 13 or conversely removed from the tool rack 13 and arranged in the tool holder 17. For this purpose, it is provided that the guide track 4 is then disposed in longitudinal direction of the tool holder 17 and thus a connection is formed between the machine tool 12 and the tool rack 13. In this guide track, the tool-transfer device 1 is disposed movably, wherein this is moved in the guide track 4 by means of a manipulator disposed on the hitching device 10. It is equally possible that the tool-transfer device 1 has drive means, in order to be able to move autonomously in the guide track 4. Since the specific embodiment is not of importance for the further consideration, it will not be described further herein. Possibilities are known to the person skilled in the art of how a tool-transfer device can be moved along a guide track.

Since the energy store 8 of the tool-transfer device 1 is designed, preferably rechargeably, for operation of the activating device 7 and of the electromagnet of the retaining device 5, it is provided that the tool-transfer device 1 is moved during loading pauses to a waiting position, so that the charging contact 9 of the tool-transfer device 1 is brought into connection with a charging terminal 30 at the waiting position. Thus an automatic recharging of the energy store 8 takes place during charging pauses.

FIG. 1 shows the situation in which the tool-transfer device 1 has picked up a machining tool 18 from the machining position 19. For this purpose, the tool-transfer device 1 is brought to the pick-up position in the immediate vicinity of the arranged machining tool and the magnetic retaining device 5 is activated by the activating device 7, and thus a magnetic retaining force is established between the transfer device 1 and the machining tool 18. In order to be able to remove the bending tool from the tool holder 17, this must be unlocked or released by a machine controller. Together with activated, magnetic retaining device 5, the tool-transfer device 1 moves the machining tool 18 along the guide track 4 to the deposition position, which in this case is the tool rack 13.

FIG. 3 now shows several variants in which a machining tool 18 is picked up at a pick-up position 20 and moved along the guide track 4 to a deposition position 21 and deposited there. The upper diagram illustrates the magnetic retaining force 22 and the lower diagram the activating current 23 with which the electromagnet of the tool-transfer device is operated by the activating device.

Figure 3A:
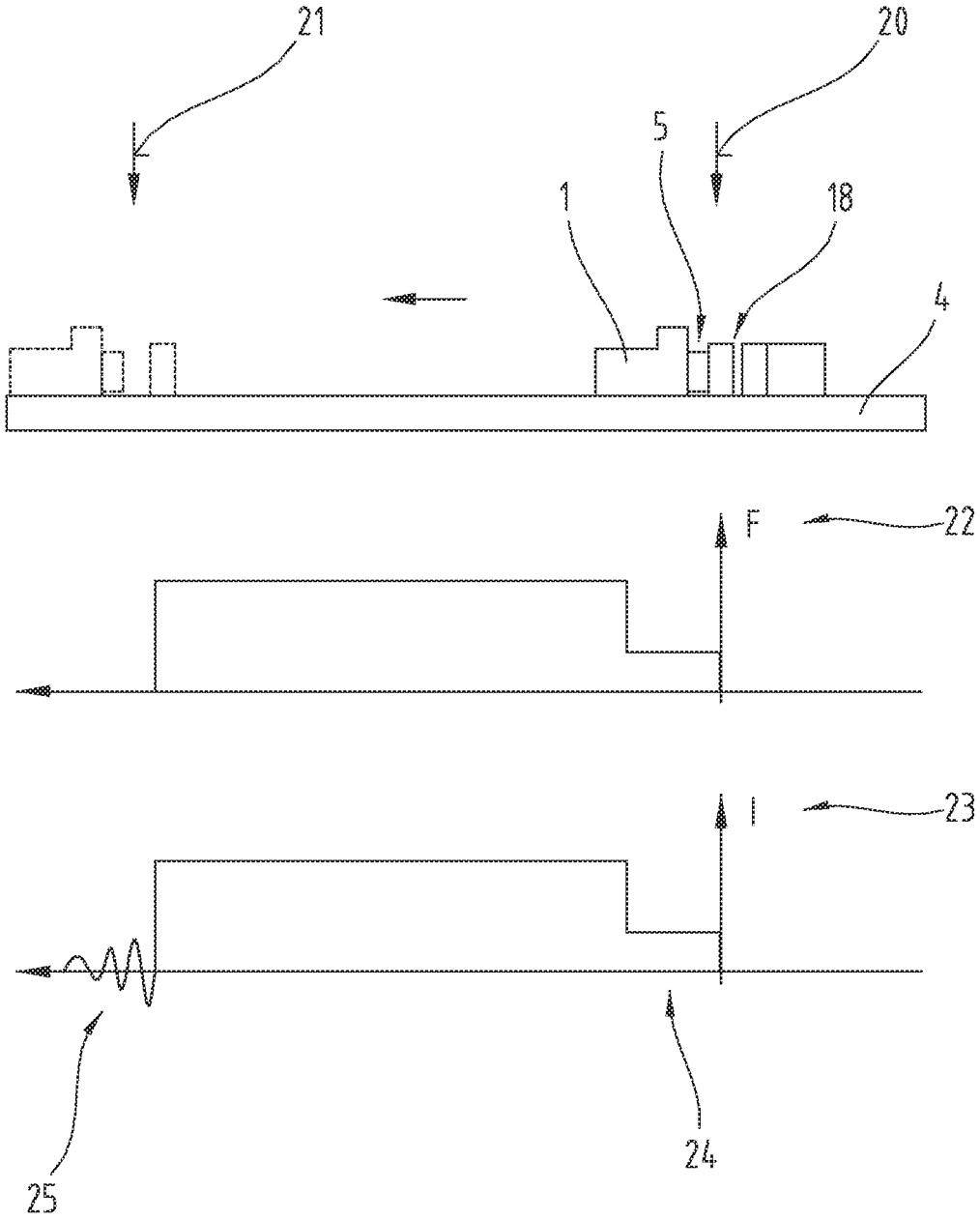
FIG. 3 shows various possible modes of operation of the tool-transfer device.

FIG. 3*a* shows the pick-up of a small machining tool 18, wherein small means that the machining tool 18 on the one hand has a light weight and above all is short in the direction of the extent of the guide track 4. In the case of such short tools, it is possible that, during admission of high current to the magnetic retaining device 5 and associated therewith the generation of a strong magnetic field, the bending tool to be picked up will be bulk magnetized and a second bending tool arranged after it will likewise be retained. Thus the danger exists that, instead of the one tool to be picked up, two or possibly further bending tools will cling persistently to the magnetic retaining device 5 of the tool-transfer device 1. In order to prevent this, it is provided according to the illustrated embodiment that, in one portion 24 of the electromagnet, only a small activating current 23 is admitted and thus only a correspondingly small magnetic retaining force 22 is also generated. As soon as the tool has been picked up and removed by a distance from the remaining, arranged machining tools 18, the electromagnet of the retaining device 5 is subjected by the activating device of the tool-transfer device 1 to a higher activating current 23, whereby the magnetic holding force 22 is also increased. This means that the picked-up tool is retained effectively and securely, whereby higher speeds of movement along the guide track 4 are also possible.

Due to the action of the magnetic retaining force 22 on the picked-up machining tool 18 as well as on the magnetic retaining device 5, a buildup of a residual magnetism takes place in these. Without appropriate countermeasures, this would strengthen upon each pick-up and retention cycle to a degree that the tool and the retaining device acquire permanent magnetic properties and thus a reliable pick-up and deposition would no longer be possible. In particular, it may then occur that the machining tools 18 cling so strongly to one another that they can no longer be separated from one another without an additional mechanical separating aid. It is therefore provided in the loading method according to the invention that, at the deposition position 21, a demagnetization process is performed that consists, for example, in that the electromagnet of the magnetic retaining device 5 is subjected to an alternating current 25 having decreasing amplitude. The decrease of the amplitude preferably takes place according to an exp(−x) function. At the end of the demagnetization process, a residual magnet field in the tool or in the retaining device is dissipated, or at least greatly reduced.

Figure 3B:
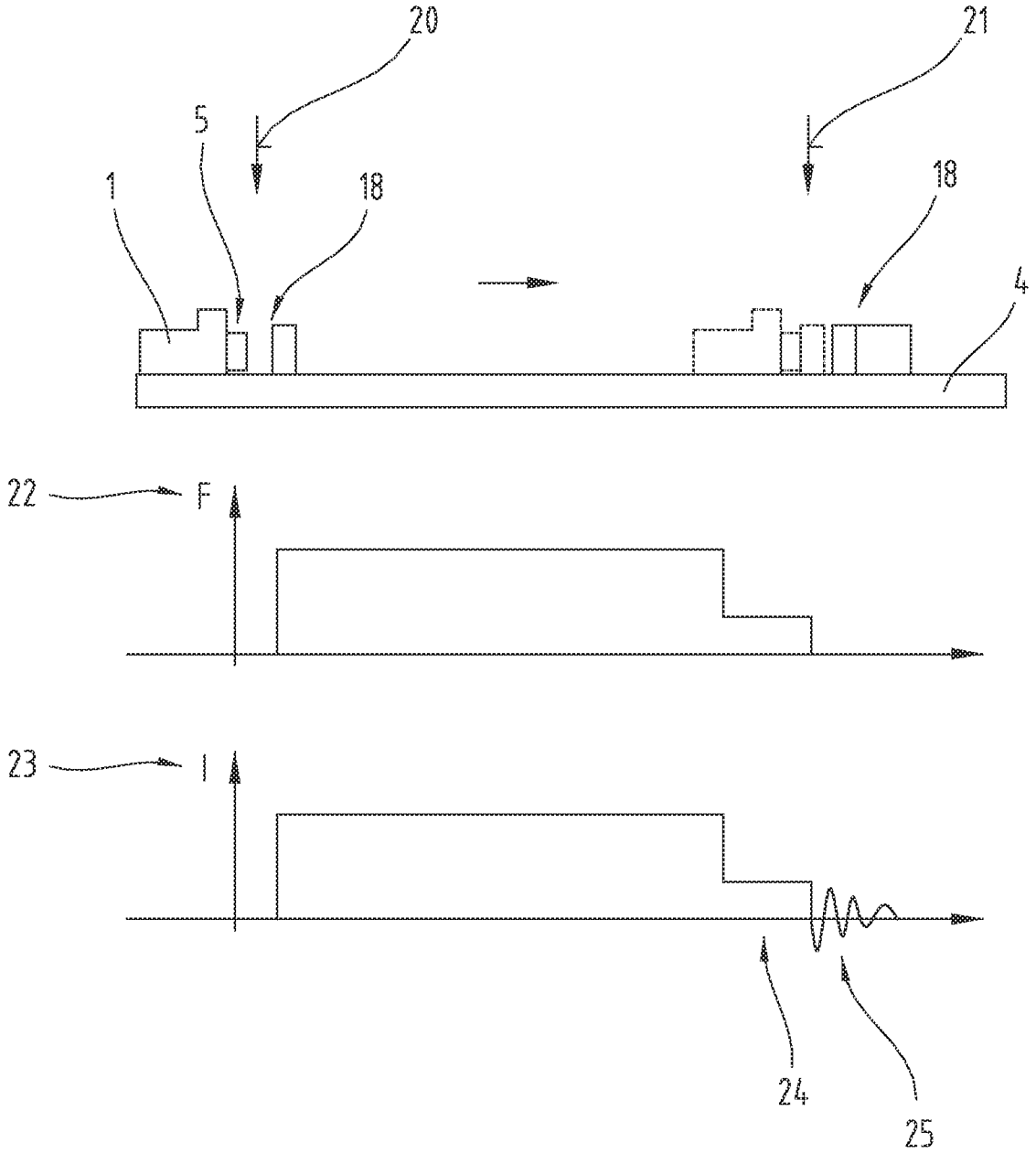

FIG. 3*b* shows a situation in which a small machining tool 18 is picked up at the pick-up position 20 and moved to the deposition position 21, wherein further machining tools 18 are already arranged at the deposition position 21. In order to prevent a bending tool present at the deposition position 21 from being attracted by the bending tool picked up by means of magnetic retaining force of the tool-transfer device 1, it is likewise provided that the current due to the activating current 23 and thus the retaining force 22 is reduced in a portion 24 prior to reaching of the deposition position 21.

Here also, the magnetic retaining force 22 is deactivated upon reaching of the deposition position, and a demagnetization is performed by application of an alternating current 25 to the electromagnets of the retaining device 5.

Since in this case the machining tool 18 is pushed by the tool-transfer device 1 along the guide track 4, it is also possible, according to a further embodiment, for the magnetic retaining force 22 to be deactivated and the demagnetization to be performed already after pick-up of the machining tool 18 at the pick-up position 20, after which the tool merely lies on the tool-transfer device 1 and is pushed by it to the deposition position 21.

Figure 4:
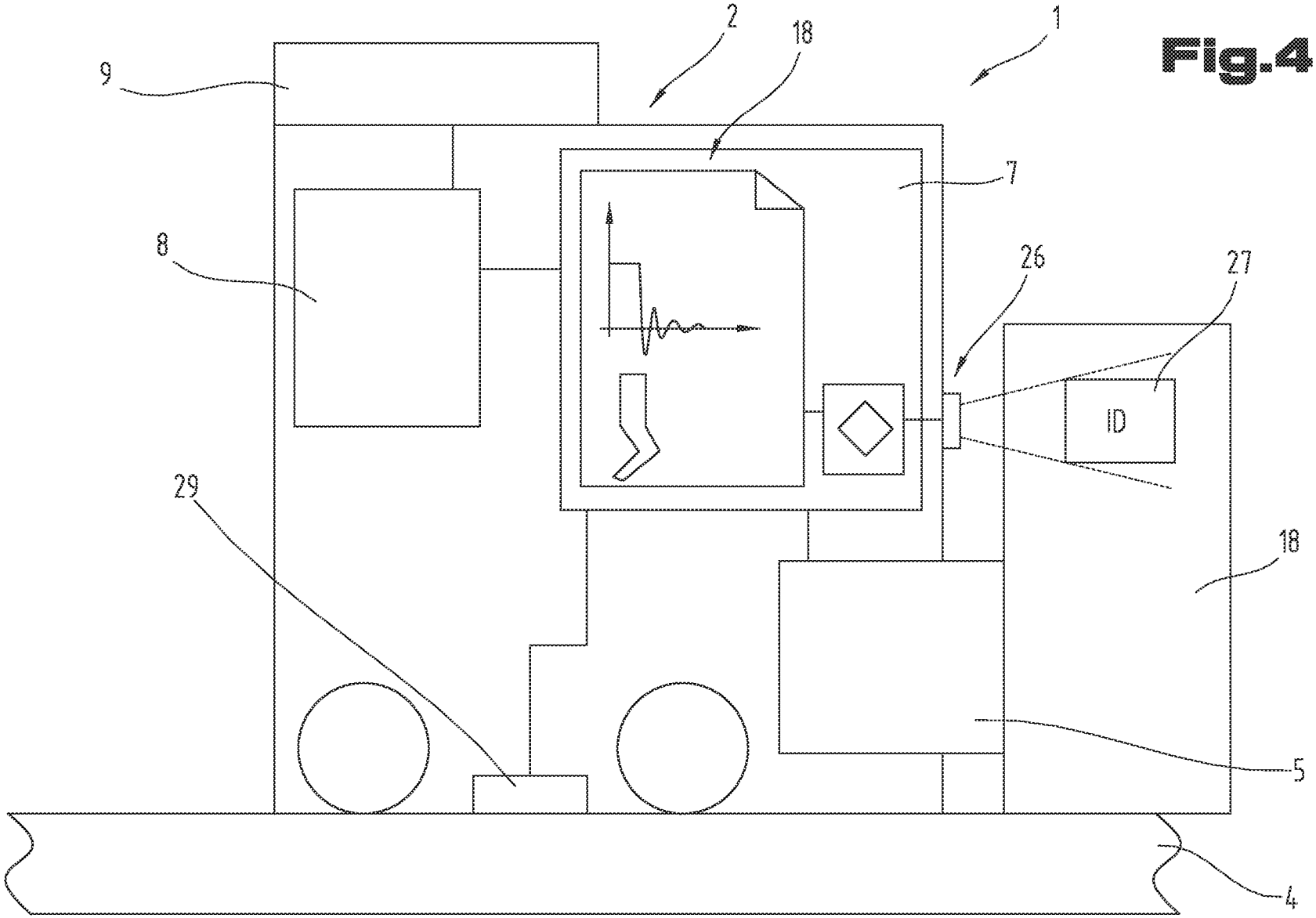
FIG. 4 shows a further possible embodiment of the subject tool-transfer device.

Further possible embodiment variants are illustrated in FIG. 4. For example, a sensing means 26, which is connected to the activating device 7 and which is designed to read an identification feature 27 of the machining tool 18, may be provided on the tool-transfer device 1. From the read identification feature 27, tool-characterizing data, especially a tool shape, a tool weight and/or a tool length, can be extracted by the activating device 7. In the activating device 7, for example in a memory means, a table 28 may be provided, in which table 28, based on the extracted tool weight, the tool size or the tool shape, parameters are resident for the signal strength of the electrical activating signal for the supply of the magnetic retaining device 5.

For determination of the position of the tool-transfer device 1 along the guide rail 4, especially for determination of the pick-up or deposition position, it may be further provided that a position sensor 29 is present together with the activating device 7. This position sensor 29 may sense or scan, for example, a marking disposed on the guide track 4, and from this determine a position.

The position sensor 29 may also be designed as a distance sensor and preferably be disposed at the front axial end of the housing 2. Thereby the transfer device is automatically able to recognize an approach to a tool, and so no additional devices or markings have to be provided on the guide track or the machine tool. The advantage of the subject loading method or of the subject tool-transfer device lies in particular in that, by means of a simple and compact device, a faster tool change is permitted, especially without use of additional manipulators. A feedback effect on the tool or the transfer device due to the magnetism being used can be prevented.

Finally, it is pointed out that like parts in the differently described embodiments are denoted with like reference symbols or like structural-part designations, wherein the disclosures contained in the entire description can be carried over logically to like parts with like reference symbols or like structural-part designations. The position indications chosen in the description, such as top, bottom, side, etc., for example, are also relative to the figure being directly described as well as illustrated, and these position indications are to be logically carried over to the new position upon a position change.

The exemplary embodiments show possible embodiment variants, wherein it must be noted at this place that the invention is not restricted to the specially illustrated embodiment variants of the same, but to the contrary diverse combinations of the individual embodiment variants with one another are also possible and, on the basis of the teaching of the technical handling by the subject invention, this variation possibility lies within the know-how of the person skilled in the art and active in this technical field.

The scope of protection is defined by the claims. However, the description and the drawings are to be used for interpretation of the claims. Individual features or combinations of features from the shown and described different exemplary embodiments may represent inventive solutions that are independent in themselves. The task underlying the independent inventive solutions may be inferred from the description.

All statements about value ranges in the description of the subject matter are to be understood to the effect that they jointly comprise any desired and all sub-ranges therefrom, e.g. the statement 1 to 10 is to be understood to the effect that all sub-ranges, starting from the lower limit 1 and the upper limit 10 are jointly comprised, i.e. all sub-ranges begin with a lower range of 1 or greater and end at an upper limit of 10 or smaller, e.g. 1 to 1.7, or 3.2 to 8.1, or 5.5 to 10.

Finally, it must be pointed out, as a matter of form, that some elements have been illustrated not to scale and/or enlarged and/or reduced for better understanding of the structure.

LIST OF REFERENCE NUMERALS

1 Tool-transfer device
2 Outer housing
3 Guide device
4 Guide track
5 Retaining device
6 Electromagnet
7 Activating device
8 Energy store
9 Charging contact
10 Hitching device
11 Machining system
12 Machine tool
13 Tool rack
14 Machine frame
15 Pressing beam
16 Machine table
17 Tool holder
18 Machining tool
19 Machining position
20 Pick-up position
21 Deposition position
22 Retaining force
23 Activating current
24 Portion
25 Alternating current
26 Sensing means
27 Identification feature
28 Table
29 Position sensor
30 Charging terminal

The invention claimed is:

1. A loading method for a bending machine, having
a tool-transfer device,
a tool holder of the bending machine, and
a tool rack,
wherein
the tool holder and the tool rack are connected via a guide track, and
the tool-transfer device is disposed movably along the guide track,
and wherein
bending tools are arranged in the tool holder and/or in the tool rack, and
the tool-transfer device has a magnetic retaining device, comprising the steps of:
moving the tool-transfer device to a bending tool, which is arranged in a pick-up position in the tool holder or in the tool rack;
picking-up and retaining the bending tool by activating magnetic retaining force of the magnetic retaining device of the tool-transfer device;
moving the picked-up bending tool along the guide track to a deposition position in the tool rack or in the tool holder;
depositing the bending tool by deactivating the magnetic retaining force;
wherein the magnetic retaining device has an electromagnet having an electronic activating device wherein, upon deactivating the magnetic retaining force, the electronic activating device demagnetizes the electromagnet and wherein the tool-transfer device has an electrical energy store connected to the electronic activating device and a charging contact connected to the energy store, wherein, after the tool-transfer device moves along the guide track into a waiting position, the charging contact of the tool-transfer device is brought into connection with a charging terminal of the waiting position.

2. The loading method according to claim 1, wherein the electromagnet, during deactivation of the magnetic retaining force, is subjected by the electronic activating device to an electrical alternating current with decreasing signal amplitude.

3. The loading method according to claim 1, wherein the magnetic retaining device additionally has a permanent magnet, wherein the electromagnet, during deactivation of the magnetic retaining force, is subjected by the electronic activating device to a direct-component-containing electrical alternating signal having decreasing signal amplitude.

4. The loading method according to claim 1, wherein, during the pick-up of the bending tool, the electromagnet is subjected by the electronic activating device to an electrical pick-up and retention signal.

5. The loading method according to claim 4, wherein the strength of the pick-up and retention signal of the electronic activating device is changed over between a first signal strength for the pick-up of the bending tool and a second signal strength for the retention of the bending tool.

6. The loading method according to claim 5, wherein, for the retention of the bending tool, the second signal strength of the pick-up and retention signal is disconnected.

7. The loading method according to claim 5, wherein the second signal strength of the pick-up and retention signal is reduced prior to reaching of the deposition position.

8. The loading method according to claim 5, wherein an identification feature of the bending tool is read by a sensing means connected to the electronic activating device, and tool-characterizing data are extracted from the identification feature by the electronic activating device.

9. The loading method according to claim 8, wherein, based on an extracted tool weight and/or a tool length, the first signal strength and/or the second signal strength is read by the electronic activating device from a resident parameter table.

10. The loading method according to claim 4, wherein the pick-up and retention signal is output by the electronic activating device as a PWM signal or PPM signal.

11. The loading method according to claim 1, wherein the tool-transfer device has, connected to the electronic activating device, a position sensor, which determines the position of the tool-transfer device along the guide track and communicates a reaching of the pick-up position and/or a reaching of the deposition position to the electronic activating device.

12. The loading method according to claim 1, wherein the demagnetization is applied prior to reaching of the deposition position.

13. The tool-transfer device for the loading method according to claim 1, comprising an outer housing, a guide device for pick-up of the transfer device in the guide track, the magnetic retaining device disposed on a front axial end of the housing, wherein the magnetic retaining device has the electromagnet, and wherein the electronic activating device is present, which is designed for the supply of the electromagnet with an electrical demagnetization signal, which demagnetization signal is an alternating signal having declining amplitude and wherein the rechargeable energy store, which is connected to the charging contact on a housing outer side, is present in the outer housing.

14. The tool-transfer device according to claim 13, wherein the outer housing has an energy and/or data interface.

15. The tool-transfer device according to claim 14, wherein a hitching device for a manipulator is provided at a rear axial end of the housing.

16. The tool-transfer device according to claim 14, wherein the guide device has a drive, which is designed for movement of the transfer device along the guide track.

17. The tool-transfer device according to claim 14, wherein the electronic activating device has a table, in which tool-characterizing data and associated parameters of a tool pick-up and retention signal are resident.

18. The tool-transfer device according to claim 14, wherein a second electromagnet is disposed in one portion on the guide track.

* * * * *